US008087330B2

(12) United States Patent
Hsieh

(10) Patent No.: US 8,087,330 B2
(45) Date of Patent: Jan. 3, 2012

(54) HAND TOOL WITH WARNING EFFECT

(76) Inventor: Chih-Ching Hsieh, Taichung Hsien (TW)

( * ) Notice: Subject to any disclaimer, the term of this patent is extended or adjusted under 35 U.S.C. 154(b) by 382 days.

(21) Appl. No.: 12/538,254

(22) Filed: Aug. 10, 2009

(65) Prior Publication Data

US 2009/0288526 A1 Nov. 26, 2009

Related U.S. Application Data

(63) Continuation-in-part of application No. 11/633,225, filed on Dec. 5, 2006, now abandoned.

(51) Int. Cl.
*B25B 23/144* (2006.01)

(52) U.S. Cl. ..... 81/479

(58) Field of Classification Search ..... 81/477, 81/479

See application file for complete search history.

(56) References Cited

U.S. PATENT DOCUMENTS

| | | | |
|---|---|---|---|
| 4,244,434 | A | 1/1981 | Wilson |
| 4,669,319 | A | 6/1987 | Heyraud |
| 4,854,045 | A | 8/1989 | Schaub |
| 4,958,541 | A | 9/1990 | Annis et al. |
| 6,273,582 | B1 | 8/2001 | Taggart et al. |
| 6,276,243 | B1 | 8/2001 | Jenkins |
| 6,341,423 | B1 | 1/2002 | Taggart et al. |
| 6,968,759 | B2 | 11/2005 | Becker et al. |
| 6,981,436 | B2 | 1/2006 | Becker et al. |
| 7,036,407 | B2 | 5/2006 | Pyre et al. |
| 7,107,884 | B2 | 9/2006 | Cutler et al. |
| 7,146,667 | B2 | 12/2006 | Elsener |
| 2004/0187652 | A1 | 9/2004 | Pyre et al. |
| 2005/0072278 | A1 | 4/2005 | Cutler et al. |
| 2005/0092143 | A1 | 5/2005 | Lehnert et al. |
| 2005/0204877 | A1 | 9/2005 | Royko |
| 2006/0087845 | A1 | 4/2006 | Yeh |
| 2006/0292997 | A1 | 12/2006 | Yang |

*Primary Examiner* — David B Thomas
(74) *Attorney, Agent, or Firm* — Guice Patents PLLC

(57) ABSTRACT

The present invention provides a hand tool with warning effect. A torque sensor, a music player and a circuit device are disposed in a main body of the hand tool. The circuit device includes a processing unit and a warning sound generator. An operation torque detected by the torque sensor is transmitted to the processing unit. In the case that the value of the operation torque is within a set range, the processing unit shuts off the warning sound generator and the music player can play music for a user to listen to. Once the operation torque of the hand tool becomes greater than the set torque value, the processing unit turns on the warning sound generator to emit a warning signal to alert the user.

20 Claims, 8 Drawing Sheets

HAND TOOL WITH WARNING EFFECT

This application is a Continuation-in-Part of application Ser. No. 11/633,225, entitled HAND TOOL WITH EARPHONE, filed on Dec. 5, 2006 now abandoned.

FIELD OF THE INVENTION

The present invention relates generally to a hand tool, and more particularly to a hand tool with warning effect. In the case that the operation torque of the hand tool exceeds a set value, the hand tool will emit a warning sound to warn a user.

BACKGROUND OF THE INVENTION

Many existent hand tools have torque value detection function. In the case that the operation torque exceeds a set value, the hand tool will emit a warning sound to warn a user.

However, in a noisy environment, it is hard for a user to hear the warning sound. U.S. patent Ser. No. 11/633,225 of this applicant discloses a hand tool with an earphone. In operation, a user can wear the earphone to listen to music. In abnormal state, the user can hear a warning sound from the earphone.

SUMMARY OF THE INVENTION

It is therefore a primary object of the present invention to provide a hand tool with warning effect. In the case that the operation torque of the hand tool exceeds a set value, the hand tool will provide warning effect to warn a user.

It is a further object of the present invention to provide the above hand tool with warning effect. In normal state, the hand tool can play music for a user to listen to.

To achieve the above and other objects, the hand tool with warning effect of the present invention includes a main body. A torque sensor, a music player and a circuit device are disposed in the main body. The circuit device includes a processing unit and a warning sound generator. An operation torque detected by the torque sensor is transmitted to the processing unit so that the processing unit compares the detected torque value with a set torque value. In the case that the value of the operation torque is within a set range, the processing unit shuts off the warning sound generator and the music player can play music for a user to listen to. Once the operation torque of the hand tool becomes greater than the set torque value, the processing unit turns on the warning sound generator to emit a warning signal to alert the user.

The processing unit could turn on/off the warning sound generator via a signal switching buffer.

The present invention can be best understood through the following description and accompanying drawings wherein:

DETAILED DESCRIPTION OF THE PREFERRED EMBODIMENTS

Figure 1:
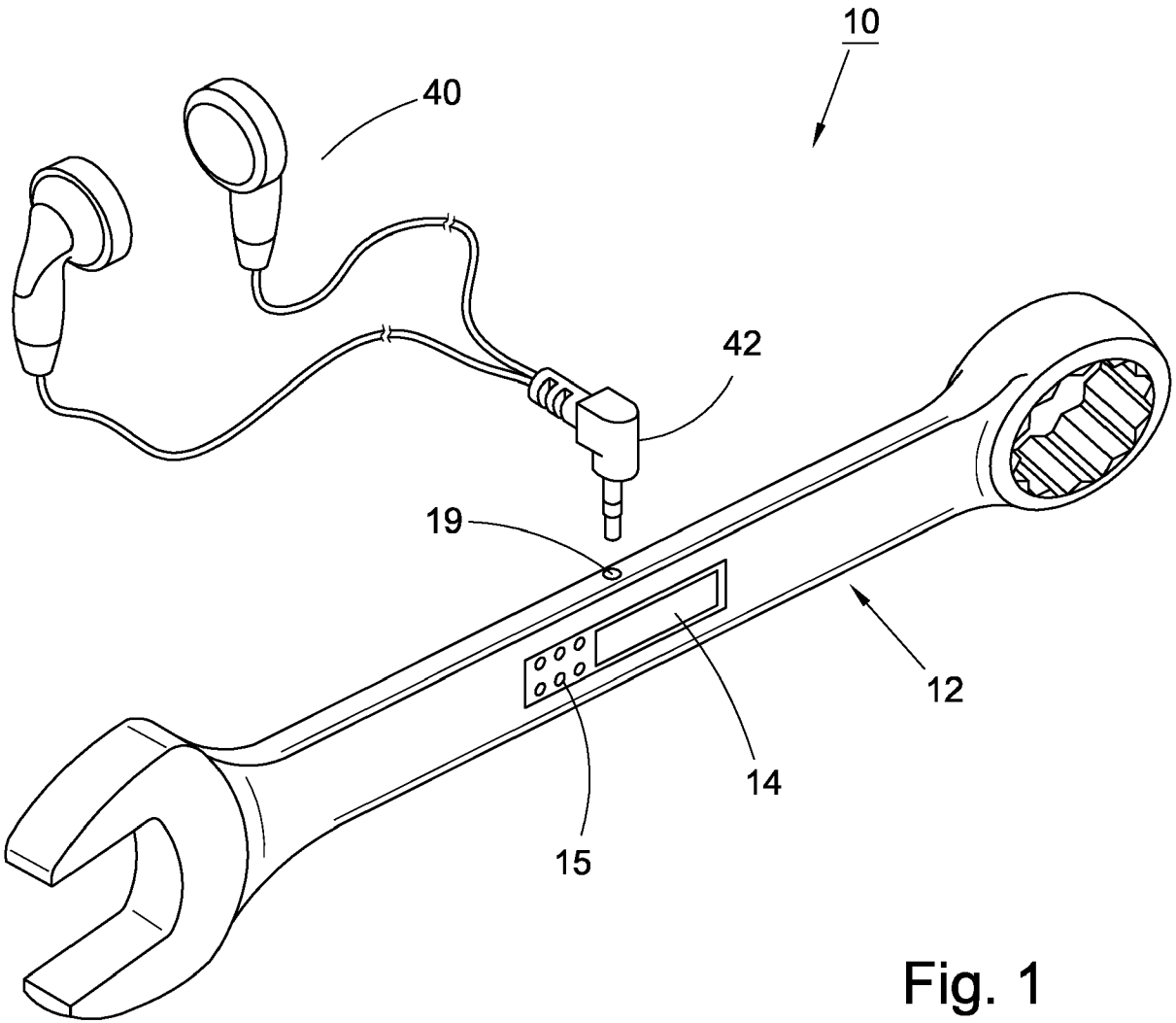
FIG. 1 is a perspective view of a first embodiment of the present invention.
Figure 7:
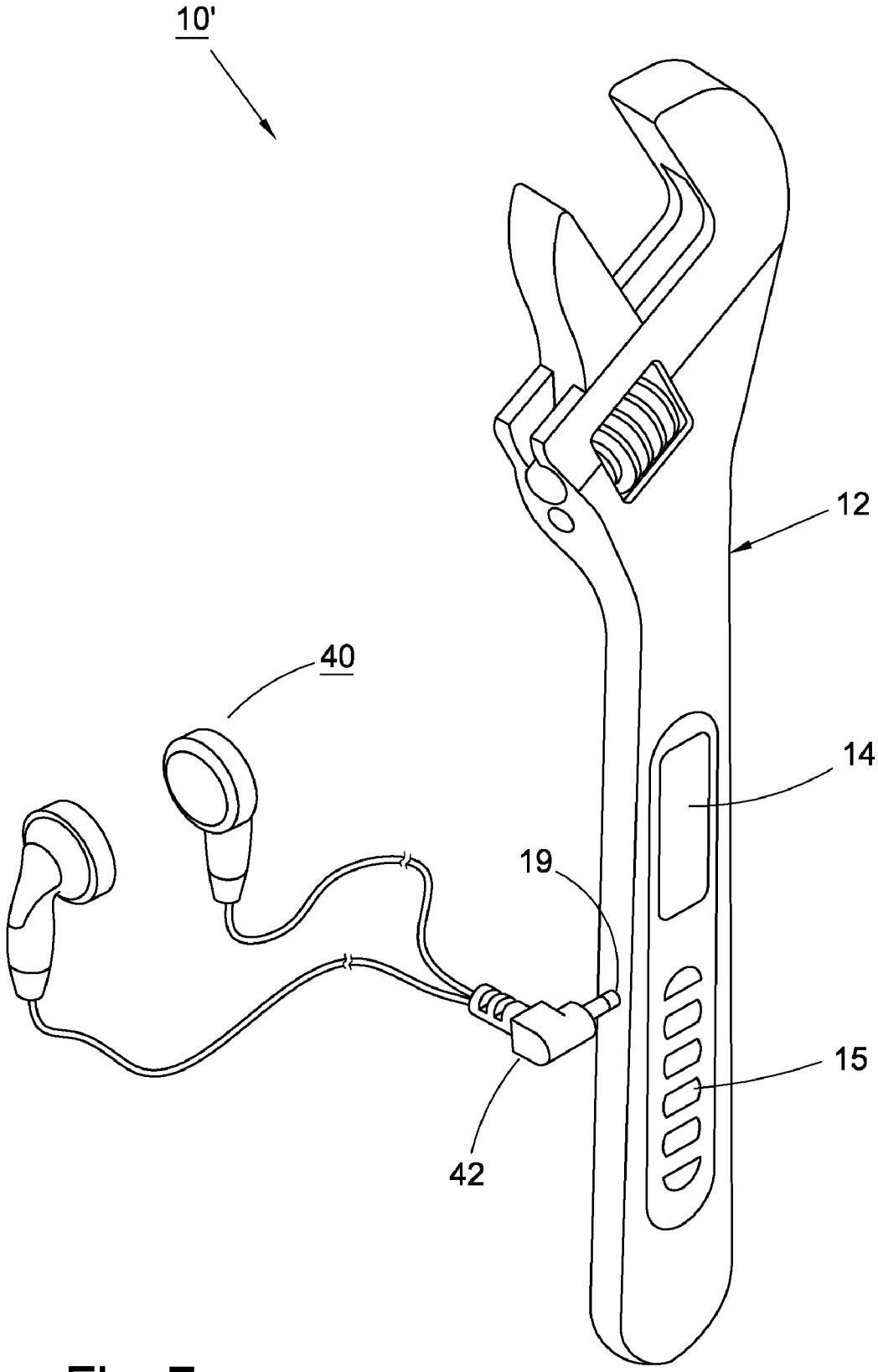
FIG. 7 is a perspective view showing that the present invention is applied to another type of hand tool.
Figure 8:
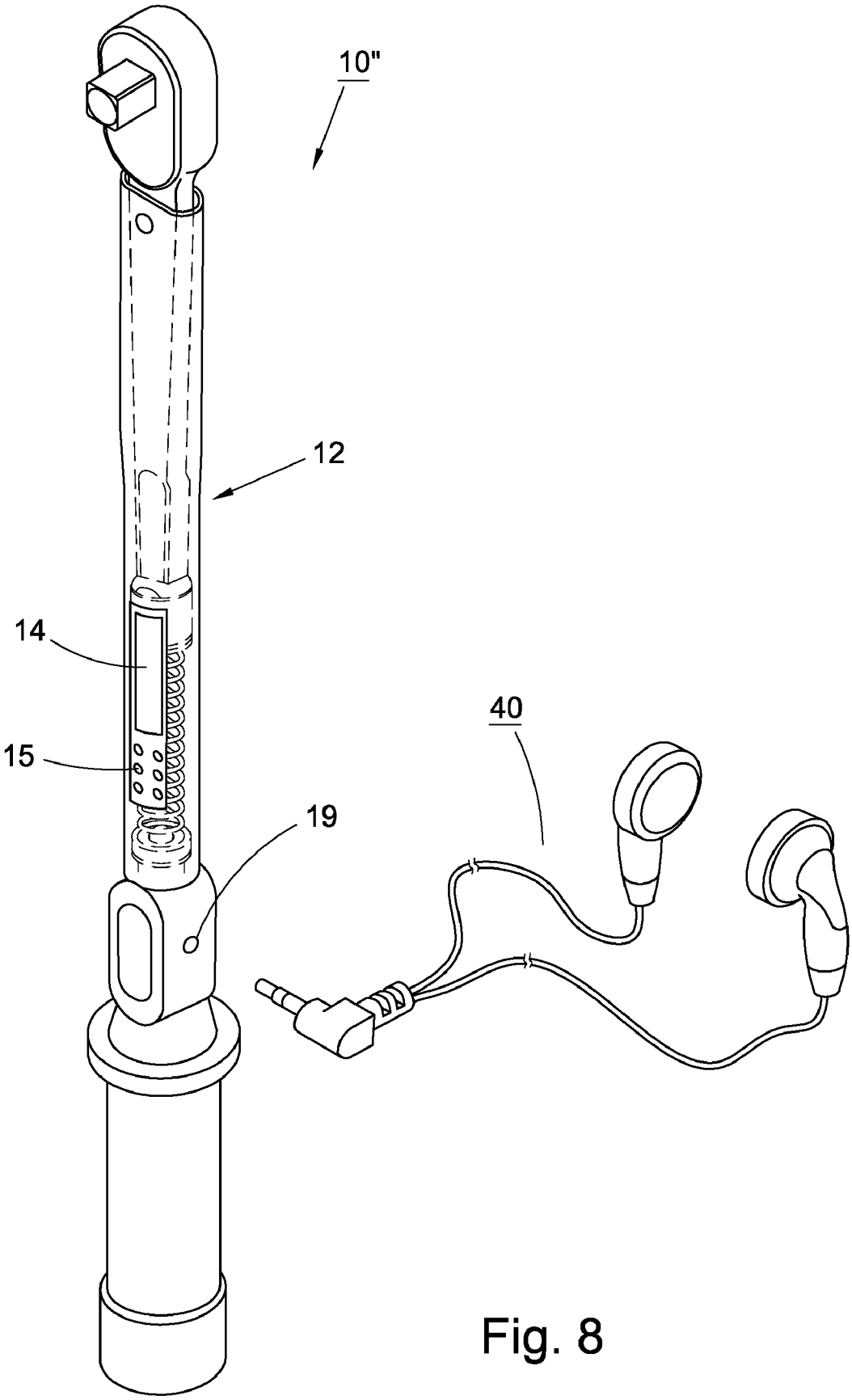
FIG. 8 is a perspective view showing that the present invention is applied to still another type of hand tool.

The present invention is applicable to any type of hand tool with wrenching function, such as a wrench or a screwdriver. FIGS. 1, 7 and 8 respectively show different types of wrenches to which the present invention is applicable.

Figure 2:
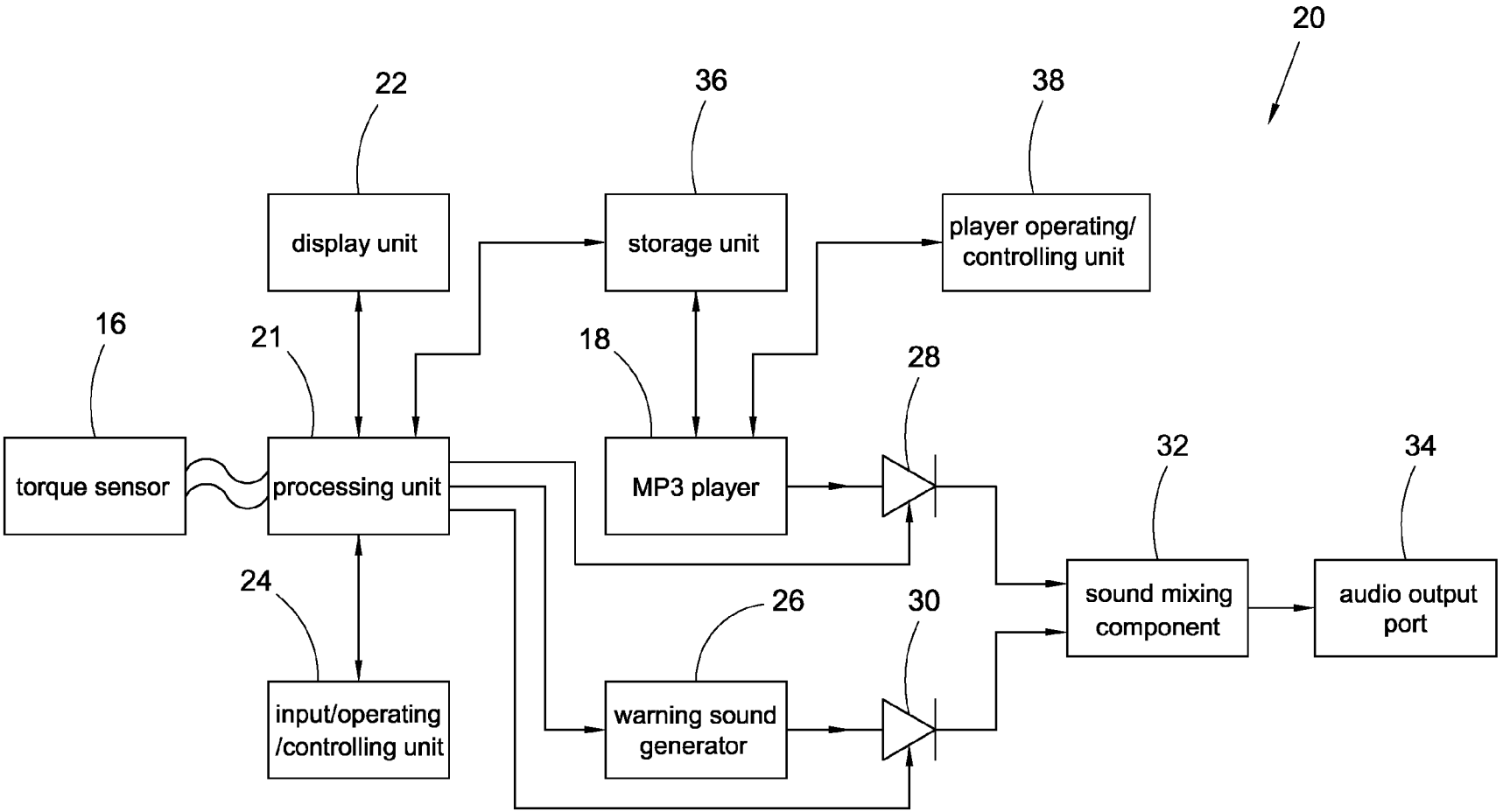
FIG. 2 is a block diagram of the first embodiment of the present invention.

Please refer to FIG. 1. According to a first embodiment of the present invention, the hand tool 10 has a main body 12, a display panel 14 and several press keys 15 arranged on the main body 12. Referring to FIG. 2, a circuit device 20 and a torque sensor 16 are disposed in the main body 12. The torque sensor 16 can be a strain gauge for sensing the flexure of the main body and transmitting an electronic signal to the circuit device 20. The display panel 14 is a liquid crystal display (LCD) panel for showing numerical values.

A music player 18 is further disposed in the main body 12 of the hand tool 10. For example, an MP3 digital player can be disposed in the main body 12 to play music.

Please refer to FIG. 2. The circuit device 20 includes a processing unit 21, a display unit 22, an input/operating/controlling unit 24, a warning sound generator 26, two signal switching buffers 28, 30, a sound mixing component 32 and an audio output port 34.

The processing unit 21 serves as the core of data calculation and processing. The set torque value of the hand tool is inbuilt in the processing unit 21. The display unit 22 is connected to the processing unit 21 for showing various relevant messages. The display panel 14 on the main body 12 is a display part of the display unit 22.

The torque sensor 16 is connected to the processing unit 21 for transmitting the detected torque value to the processing unit 21 in the form of electronic signal.

The input/operating/controlling unit 24 is connected to the processing unit 21 for powering on or off the circuit device and setting/adjusting the torque value stored in the processing unit 21. The press keys 15 arranged on the surface of the main body 12 are an embodiment of the input/operating/controlling unit 24 for a user to operate. The press keys 15 include numerical input keys, selection keys and reset key.

An input terminal of the warning sound generator 26 is connected to the processing unit 21 for generating warning sound.

In this embodiment, the two signal switching buffers 28, 30 are diodes. An input terminal of the first signal buffer 28 is connected to the processing unit 21, while another input terminal of the first signal buffer 28 is connected to the music player 18. An input terminal of the second signal buffer 30 is connected to an output terminal of the warning sound generator 26, while another input terminal of the second signal buffer 30 is connected to the processing unit 21. The processing unit 21 serves to control the two signal buffers 28, 30 and the warning sound generator 26 to operate or not to operate.

The sound mixing component 32 can be a sound mixing system or a sound mixer. An input terminal of the sound mixing component 32 is parallel-connected to the output terminals of the two signal buffers 28, 30.

The audio output port 34 can be an earphone port or any other type of audio output connector for outputting audio signal. The audio output port 34 is connected to an output terminal of the sound mixing component 32. The earphone port 19 on the main body 12 is an embodiment of the audio output port 34.

The main body 10 is inbuilt with a power source such as cells or a rechargeable battery for supplying necessary power for the circuit device 20 and the music player 18. Music files can be stored in the processing unit 21. Preferably, in this embodiment, an independent storage unit 36 is used to store the music files. The storage unit 36 is connected to the processing unit 21 and the music player 18. Through the operation of the input/operating/controlling unit 24 and the processing unit 21, the music files can be stored in the storage unit 36 or deleted therefrom. The music player 18 serves to pick up any of the music files of the storage unit 36 to play music.

In this embodiment, a player operating/controlling unit 38 is independently used to operate/control the music player 18. For example, the player operating/controlling unit 38 can be used to choose songs, adjust volume, power on/off the player 18. Some of the press keys 15 on the main body are an embodiment of the player operating/controlling unit 38.

Figure 3:
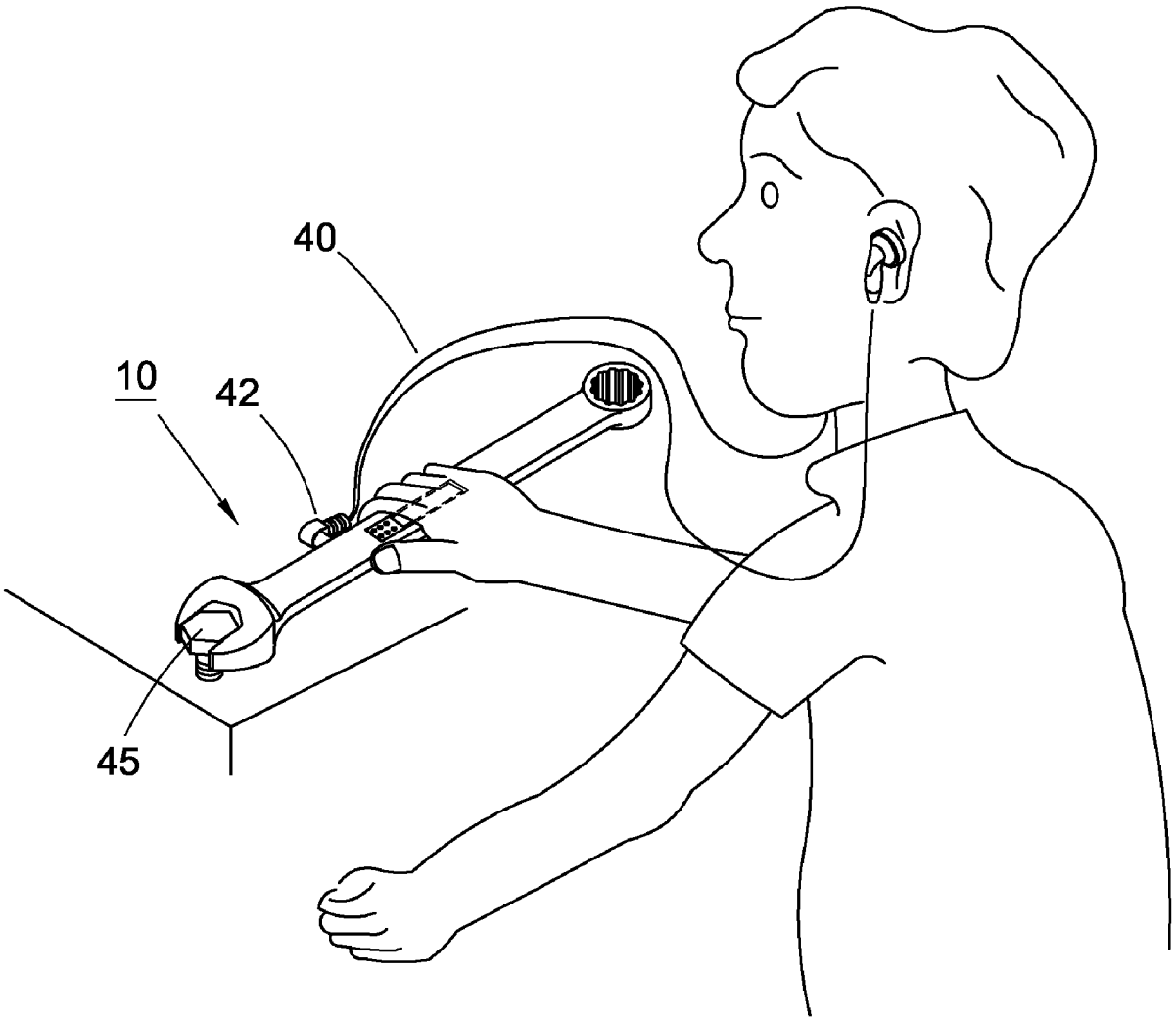
FIG. 3 is a perspective view showing the use of the present invention.

Referring to FIG. 3, when using the hand tool 10 to wrench a work piece 45, a user can plug the plug 42 of an earphone 40 into the earphone port 19 and wear the earphone 40. In working, the circuit device 20 and the music player 18 are powered on to operate. In normal state, the processing unit 21 turns on the first signal buffer 28 and turns off the warning sound generator 26 and the second signal buffer 30. After the user turns on the music player 18, audio signals can be transmitted through the first signal buffer 28 and the sound mixing component 32 to the audio output port 34 for the user to listen to the music.

Figure 4:
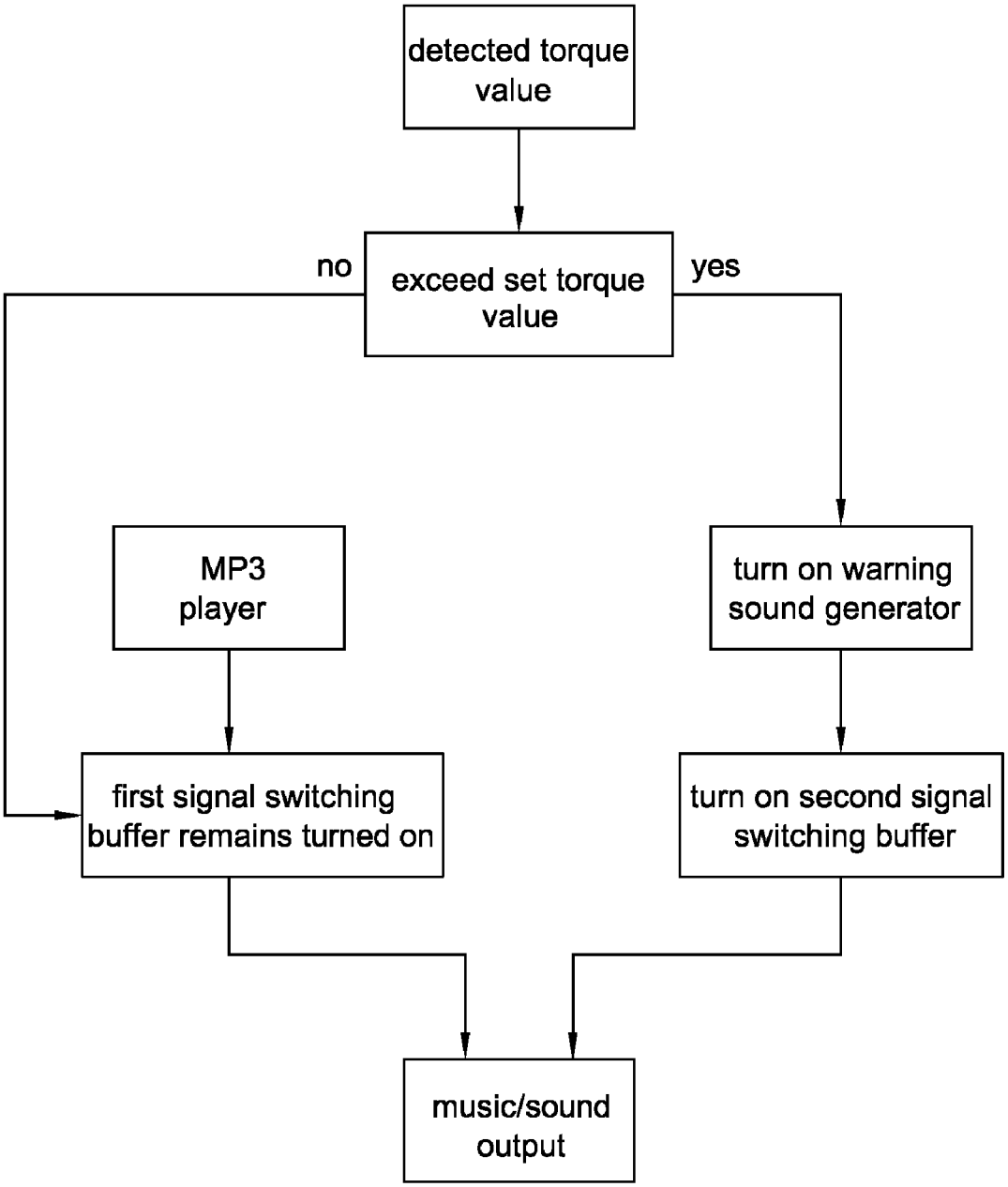
FIG. 4 is a flow chart of the operation of the first embodiment of the present invention.

Referring to FIG. 4, in use, the torque sensor 16 will detect the operation torque of the hand tool 10 and send the detected torque value to the processing unit 21. The processing unit 21 will compare the detected torque value with the set torque value. In the case that the detected torque value is less than the set torque value, this means the operation torque of the hand tool is within a safe range. Under such circumstance, the first signal buffer 28 remains turned on, permitting the user to continuously listen to the music. The operation torque value can be displayed on the display panel 14 in the form of numerals for the user to read.

Once the operation torque of the hand tool detected by the sensor 16 becomes greater than the set torque value and falls outside the safe range, after compared, the processing unit 21 will find abnormality to immediately turn off the first signal buffer 28 and power on the warning sound generator 26 and the second signal buffer 30. After turned off, the first signal buffer 28 will interrupt transmission of the audio signals of the music player 18. In this case, no matter whether the music player still operates or not, the audio signal cannot be output so that the user cannot hear the music. At this time, the warning sound generator 26 will generate a signal, which via the sound mixing component 32 is transmitted to the audio output port 34. The user can hear the warning sound to realize that the applied force has exceeded the set torque value of the hand tool. Accordingly, the user is alerted to stop operating the hand tool. The processing unit 21 can also output a signal for the display unit 22 to display a warning character such as "alarm".

It should be noted that in the case that abnormality takes place, (that is, the operation torque of the hand tool is greater than the set value), the first signal buffer 28 can remain turned on without being shut off by the processing unit 21. In this case, the music and the warning sound are output simultaneously to also provide warning effect for the user.

Figure 5:
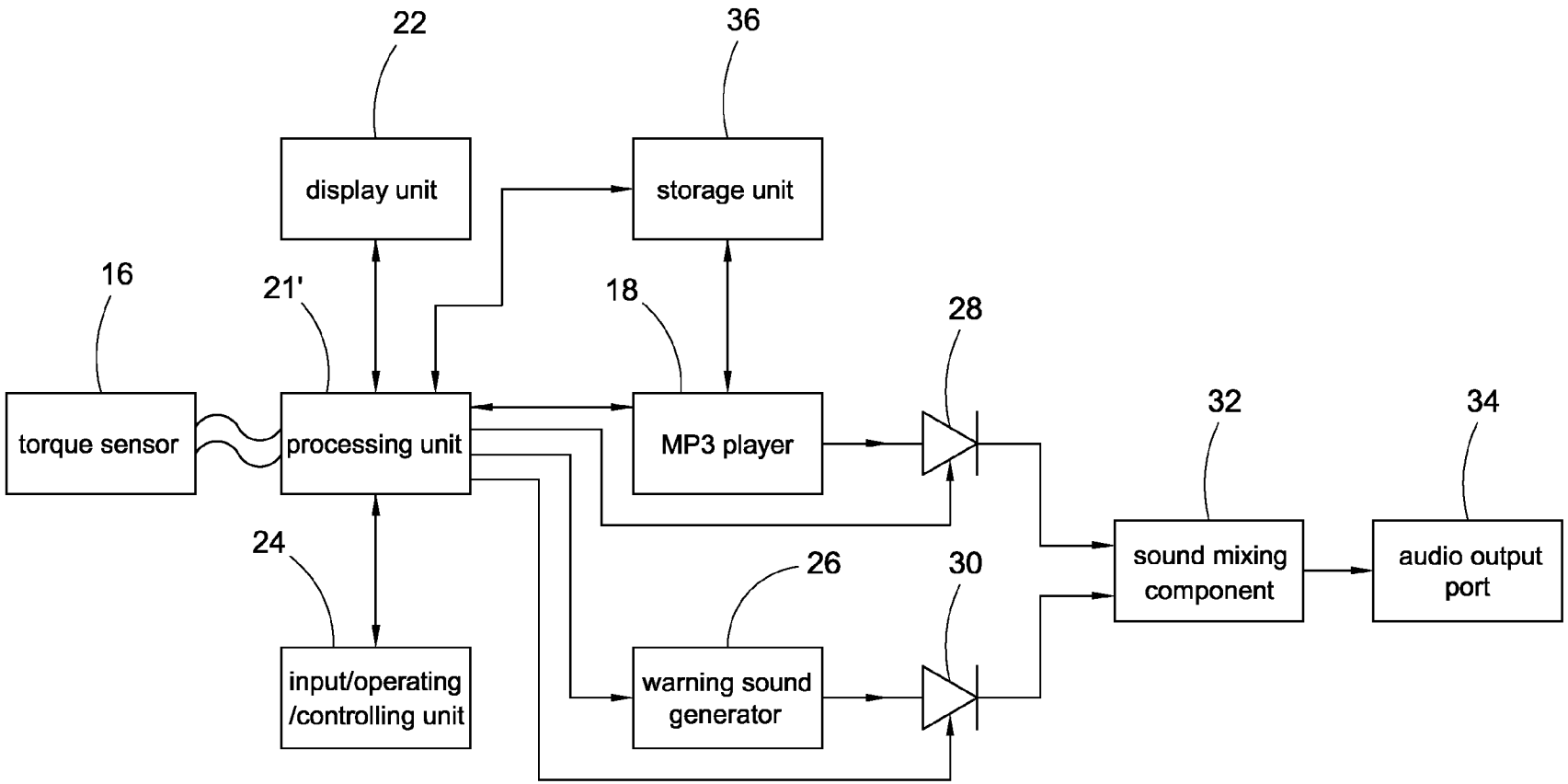
FIG. 5 is a block diagram of a second embodiment of the present invention.

FIG. 5 is a block diagram of a second embodiment of the hand tool of the present invention. The same components are denoted by the same reference numerals.

In this embodiment, the music player 18 is connected to the processing unit 21. The input/operating/controlling unit 24 is directly used to control the operation of the music player 18. Therefore, the player operating/controlling unit 38 in the first embodiment is omitted.

When the circuit device 20 is powered on, the first signal buffer 28 is turned on, while the second signal buffer 30 and the warning sound generator 26 are in turned-off state. After a user turns on the music player 18, the music signals are transmitted through the first signal buffer 28 for the user to listen to the music.

In abnormal state, the processing unit 21 will turn on the second signal buffer 30 and the warning sound generator 26, whereby the user can hear the warning sound.

In abnormal state, the first signal buffer 28 and the music player 18 can be controlled in at least three manners. According to a first manner, the first signal buffer 28 and the player 18 remain turned on, whereby the user can hear the music and the warning sound at the same time. According to a second manner, the processing unit 21 only turns off the first signal buffer 28, while the player 18 still operates. In this case, the music signals cannot be transmitted through the signal buffer 28 so that the user can only hear the warning sound. According to a third manner, the processing unit 21 turns off both the first signal buffer 28 and the player 18.

Figure 6:
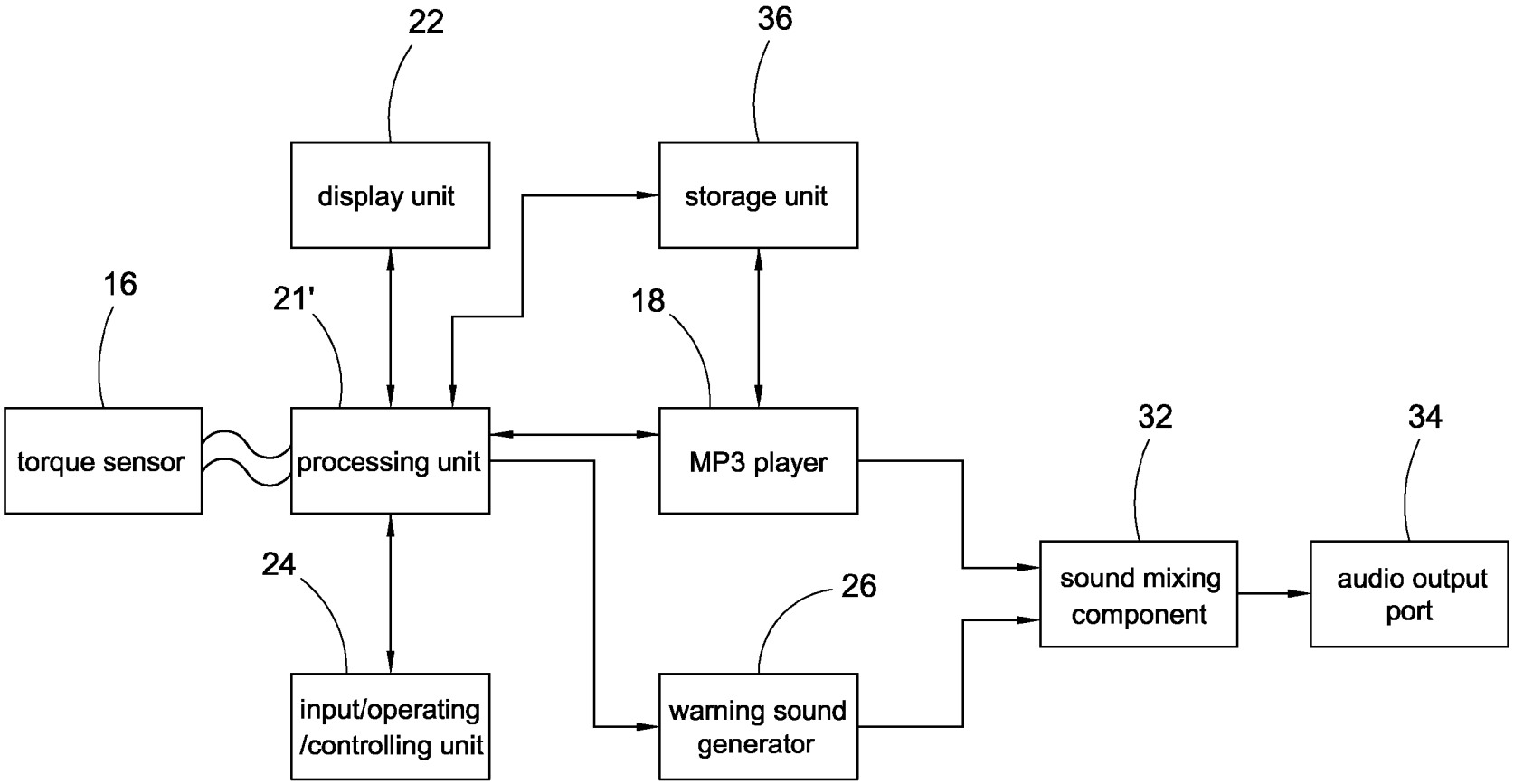
FIG. 6 is a block diagram of a third embodiment of the present invention.

FIG. 6 is a block diagram of a third embodiment of the hand tool of the present invention. The same components are denoted by the same reference numerals. In this embodiment, the processing unit 21 is directly inbuilt with the function of turning on/off the two signal buffers 28, 30. In normal state, the processing unit 21 turns on the music player 18 and turns off the warning sound generator 26, whereby the music signals are output to the audio output port 34. In abnormal state, the processing unit 21 turns off the music player 18 and turns on the warning sound generator 26 to emit a warning signal to the sound mixing component 32, which outputs a warning sound to the audio output port 34.

Similarly, in abnormal state, the music player 18 can remain in turned-on state without being shut off by the processing unit 21, whereby both the music and the warning sound are transmitted to the audio output port 34.

The hand tool of the present invention can be used in a noisy environment. A user can wear an earphone to operate the hand tool. In normal state, the user can listen to the music. In the case that the operation torque exceeds the set value, the hand tool will emit a warning sound for warning the user to stop operating the hand tool.

The above embodiments are only used to illustrate the present invention, not intended to limit the scope thereof. Many modifications of the above embodiments can be made without departing from the spirit of the present invention.

What is claimed is:

1. A hand tool with warning effect, comprising:

a main body;

a torque sensor disposed in the main body for detecting an operation torque of the hand tool;

a music player disposed in the main body for playing music; and a circuit device disposed in the main body, wherein the circuit device includes:

a processing unit for controlling operation of the circuit device, a torque value being set in the circuit device, the operation torque detected by the torque sensor being transmitted to the processing unit, the processing unit serving to compare the operation torque with the set torque value;

a display unit connected to the processing unit;

an input/operating/controlling unit connected to the processing unit;

a warning sound generator connected to the processing unit for generating warning signal;

a first signal switching buffer and a second signal switching buffer, an input terminal of the first signal switching buffer being connected to the music player and the processing unit, whereby music signals are transmitted to the first signal switching buffer, an input terminal of the second signal switching buffer being connected to the processing unit and the warning sound generator, whereby the warning signal is transmitted to the second signal switching buffer; and an audio output port; each output terminal of the two signal switching buffers being connected to the audio output port; in the case that the detected torque value is not greater than the set torque value, the first signal buffer remaining turned on, while the second signal switching buffer being shut off by the processing unit; in the case that the detected torque value exceeds the set torque value in abnormal state, the processing unit turning on the warning sound generator and the second signal switching buffer, whereby the warning signal is transmitted to the audio output port.

2. The hand tool as claimed in claim 1, further comprising a sound mixing component, each output terminal of the two signal switching buffers being connected to the sound mixing component, an input terminal of the audio output port being connected to the sound mixing component.

3. The hand tool as claimed in claim 1, wherein in abnormal state, the processing unit shuts off the first signal switching buffer.

4. The hand tool as claimed in claim 1, wherein in abnormal state, the first signal switching buffer remains turned on without being shut off by the processing unit.

5. The hand tool as claimed in claim 1, wherein the circuit device further includes a player operating/controlling unit connected to the music player for turning on/off the music player.

6. The hand tool as claimed in claim 1, wherein the music player is connected to the processing unit.

7. The hand tool as claimed in claim 6, wherein in abnormal state, the first signal switching buffer remains turned on without being shut off by the processing unit.

8. The hand tool as claimed in claim 6, wherein in abnormal state, the processing unit shuts off the first signal switching buffer.

9. The hand tool as claimed in claim 8, wherein in abnormal state, the music player remains turned on without being shut off by the processing unit.

10. The hand tool as claimed in claim 8, wherein in abnormal state, the processing unit shuts off the music player.

11. The hand tool as claimed in claim 1, wherein the set torque value is inbuilt in the processing unit.

12. The hand tool as claimed in claim 1, wherein in abnormal state, the processing unit transmits a signal to the display unit for the display unit to display a warning character.

13. The hand tool as claimed in claim 1, wherein the audio output port is an earphone port.

14. The hand tool as claimed in claim 1, wherein the two signal switching buffers are diodes.

15. A hand tool with warning effect, comprising a main body, a torque sensor, a music player and a circuit device being disposed in the main body; wherein the torque sensor serves to detect an operation torque of the hand tool, and the circuit device includes:

a processing unit for controlling operation of the circuit device, a torque value being set in the circuit device, the operation torque detected by the torque sensor being transmitted to the processing unit, the processing unit serving to compare the operation torque with the set torque value, the music player being connected to the processing unit;

a display unit connected to the processing unit;

an input/operating/controlling unit connected to the processing unit;

a warning sound generator connected to the processing unit for generating warning signal;

an audio output port, the signals of the music player and the warning sound generator being transmitted to the audio output port and output therefrom; in the case that the detected torque value is not greater than the set torque value, the processing unit shutting off the warning sound generator, in the case that the detected torque value exceeds the set torque value in abnormal state, the processing unit turning on the warning sound generator, whereby the warning signal is transmitted to the audio output port.

16. The hand tool as claimed in claim 15, further comprising a sound mixing component; each output terminal of the music player and the warning sound generator being connected to the sound mixing component, an input terminal of the audio output port being connected to the sound mixing component.

17. The hand tool as claimed in claim 15, wherein in abnormal state, the processing unit shuts off the music player.

18. The hand tool as claimed in claim 15, wherein in abnormal state, the music player remains turned on without being shut off by the processing unit.

19. The hand tool as claimed in claim 15, wherein the set torque value is inbuilt in the processing unit.

20. The hand tool as claimed in claim 15, wherein in abnormal state, the processing unit transmits a signal to the display unit for the display unit to display a warning character.

* * * * *